US007104610B2

(12) United States Patent
Cramer

(10) Patent No.: US 7,104,610 B2
(45) Date of Patent: Sep. 12, 2006

(54) APPARATUS FOR MOUNTING A WHEELCHAIR BACK

(75) Inventor: David A. Cramer, Hartland, WI (US)

(73) Assignee: Marken International, Inc., Bozeman, MT (US)

( * ) Notice: Subject to any disclaimer, the term of this patent is extended or adjusted under 35 U.S.C. 154(b) by 0 days.

(21) Appl. No.: 10/962,110

(22) Filed: Oct. 8, 2004

(65) Prior Publication Data

US 2006/0076815 A1 Apr. 13, 2006

(51) Int. Cl.
*A47C 7/40* (2006.01)

(52) U.S. Cl. ..... 297/440.2; 297/354.12; 248/230.1

(58) Field of Classification Search ..... 297/440.2, 297/440.21, 353, 354.11, 354.12, 383, 408, 297/410; 248/229.1, 230.1; 403/53–55, 403/59, 61, 63

See application file for complete search history.

(56) References Cited

U.S. PATENT DOCUMENTS

| | | | | |
|---|---|---|---|---|
| 2,124,006 | A * | 7/1938 | Parker | 248/124.2 |
| 3,640,571 | A * | 2/1972 | Keropian | 297/464 |
| 3,730,589 | A * | 5/1973 | Lane | 297/391 |
| 4,073,537 | A * | 2/1978 | Hammersburg | 297/464 |
| 5,062,677 | A | 11/1991 | Jay et al. | |
| 5,127,709 | A * | 7/1992 | Rubinstein et al. | 297/440.2 |
| 5,211,446 | A | 5/1993 | Jay et al. | |
| 5,332,287 | A * | 7/1994 | Whitmyer | 297/405 |
| 5,364,162 | A | 11/1994 | Bar et al. | |
| 5,556,168 | A | 9/1996 | Dinsmoor, II et al. | |
| 5,593,211 | A | 1/1997 | Jay et al. | |
| 5,669,536 | A * | 9/1997 | Wang | 224/443 |
| D413,085 | S * | 8/1999 | Bar et al. | D12/133 |
| 5,944,385 | A | 8/1999 | Pearce | |
| 5,971,471 | A | 10/1999 | Gardner | |
| 6,257,664 | B1 | 7/2001 | Chew et al. | |
| 6,390,426 | B1 * | 5/2002 | Berry | 248/230.1 |
| 6,460,933 | B1 | 10/2002 | Bors et al. | |
| 6,474,743 | B1 * | 11/2002 | Harker et al. | 297/440.21 |
| 6,659,563 | B1 | 12/2003 | Float et al. | |
| 6,688,693 | B1 * | 2/2004 | Christofferson et al. | 297/354.12 |
| 6,733,074 | B1 * | 5/2004 | Groth | 297/284.4 |
| 6,889,993 | B1 * | 5/2005 | Chen et al. | 280/287 |

* cited by examiner

*Primary Examiner*—Peter R. Brown
*Assistant Examiner*—Joseph Edell
(74) *Attorney, Agent, or Firm*—Joseph S. Heino; Patrick M. Bergin

(57) ABSTRACT

The present invention provides an apparatus for mounting a wheelchair back that provides a high degree of support and adjustability such that it can be used with wheelchairs that originate from a wide variety of different manufacturers. In order to provide this custom fit, the present invention provide for depth adjustability, height adjustability and angle adjustability of a wheelchair back. The present invention also provides the convenience of a quick-release wheelchair back so that the wheelchair occupant can easily remove the back of the wheelchair from the canes so that the wheelchair can be collapsed and stored. The present mounting system also provides for an effective two point mounting system that is reliable yet simple to use.

9 Claims, 10 Drawing Sheets

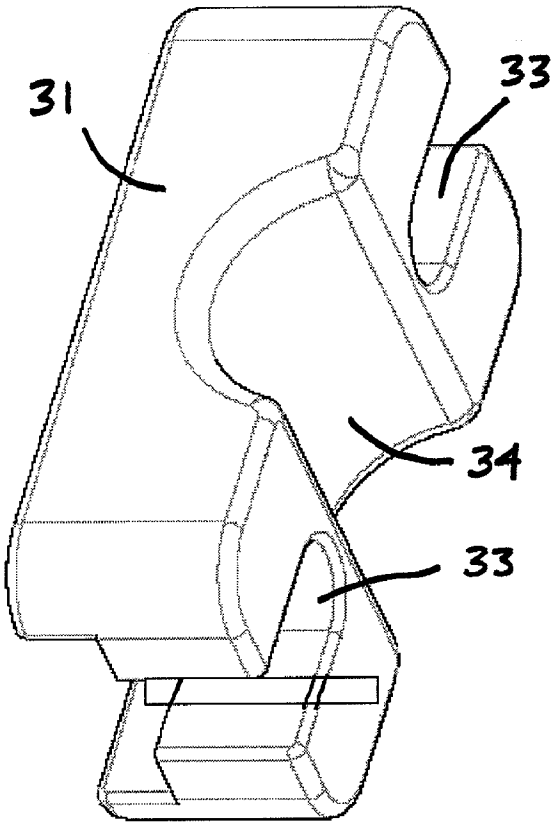
Fig. 7
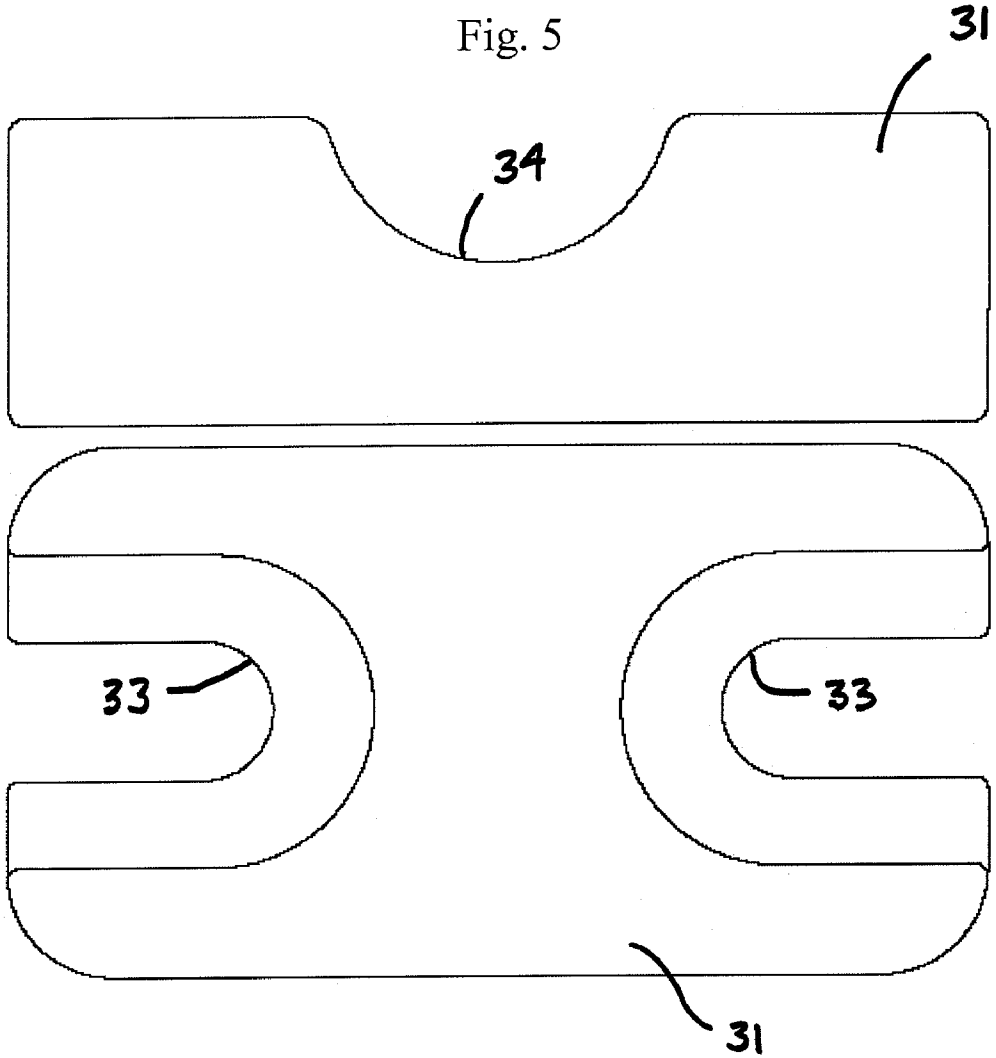
Fig. 5
Fig. 6

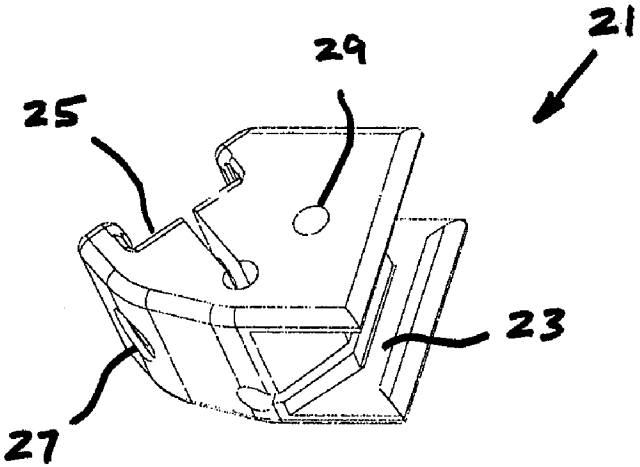
FIG. 19
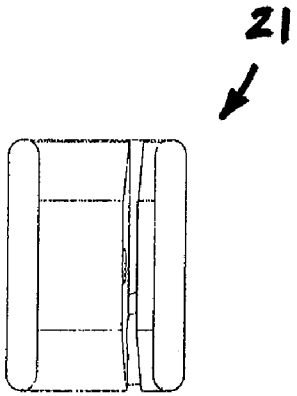
FIG. 22
FIG. 20
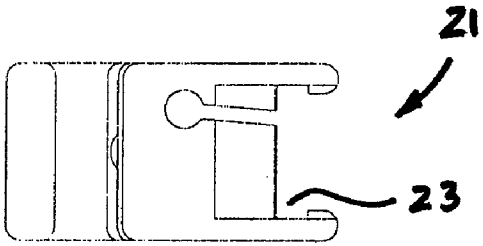
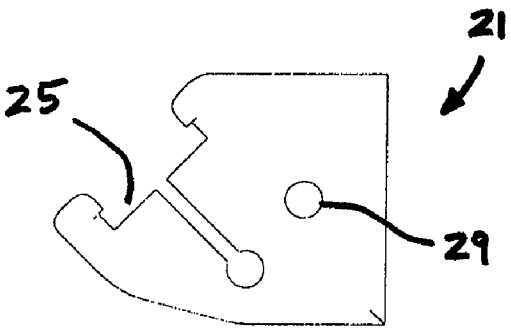
FIG. 21

APPARATUS FOR MOUNTING A WHEELCHAIR BACK

FIELD OF THE INVENTION

The present invention relates generally to wheelchairs and more specifically to adjustable wheelchair backs. In even more detail, the present invention relates to a device for mounting a wheelchair back to the upright canes of a wheelchair that provides smooth, non-incremental adjustability in three dimensions. The mounting apparatus of the present invention is also adjustable so as to precisely fit a wide variety of existing wheelchairs.

BACKGROUND OF THE INVENTION

People requiring wheelchairs include those affected with cerebral palsy, muscular dystrophy, multiple sclerosis, head injuries, etc. These individuals often suffer from kyphosis, scoliosis, lordosis and other back ailments. One of the most common complaints of wheelchair occupants is that of pain related to their use of a wheelchair. Unfortunately, at least some of the problems faced by wheelchair users are further exacerbated by the failure of current back system designs to properly position a wheelchair occupant.

One problem with current back systems is that they are difficult to install and to remove. Disabled users may need to remove and install the wheelchair back to collapse the wheelchair for storage, such as when the user enters and exits a motor vehicle.

Yet another problem with current back systems is the wide variability between commercially available wheelchairs. In particular, the upright posts of the wheelchair, or canes, often differ in configuration between wheelchairs. Specifically, in the inventor's experience, the canes may vary in diameter between 0.75" to 1.125". Additionally, the center to center distance of the canes may vary ±1" despite the manufacturer's designation. Frequently, the canes may not be perfectly vertical.

An additional problem with current wheelchair back systems is that they are not adaptable to all wheelchairs. For example, some wheelchairs, particularly those for persons having more active lifestyles, have short canes. Therefore, there is little area in which to attach a wheelchair back, which may mean that wheelchair occupants who pursue a more active lifestyle may not be able to take advantage of the positioning benefits offered by a wheelchair having an adjustable back. For example, wheelchairs for patients with special needs often have pneumatic cylinders and/or brake cables that limit the space required for mounting a back adequate to treat the particular patient. Frequently, therapist are required to mount the back support in the way it will fit, as opposed to the optimum fit for a particular user, potentially causing additional injuries to the patient. Additionally, wheelchair occupants, needing their hands for mobility, have little capacity for carrying cargo. Therefore, another problem with current wheelchair back designs is that they leave little room for mounting other carrier accessories such as bags.

Another disadvantage of current wheelchair back systems is that they provide limited adjustability for people of different sizes, shapes and physical needs. For example, a simple sling style wheelchair back provides almost no adjustability. Other wheelchair backs require a four point mounting system, which occupies lots of space along the wheelchair canes as well as limiting the ability of a therapist to position the wheelchair back. Additionally, some wheelchair backs provide limited adjustability, e.g. the wheelchair back can move vertically but has no seat depth adjustment, or the wheelchair back has seat depth adjustment but no angle adjustment.

Therefore, what is needed is a wheelchair back mounting apparatus that is adaptable to wheelchairs having canes with varying diameters and being a wide variety of widths. There is also a need for a wheelchair back mounting apparatus that takes up less space on the wheelchair canes so as to permit the attachment of other items, such as bags. There is also a need to provide a wheelchair back mounting device that provides a wide variety of adjustability so eliminate comprising the users positioning requirements and that it can position all shapes and sizes of people. Lastly, there is a need to provide a wheelchair back that is quickly and easily removable such that the wheelchair back can be removed, and the wheelchair collapsed and stored.

SUMMARY OF THE INVENTION

The present invention provides an apparatus for mounting a wheelchair back that provides a high degree of support and adjustability such that it can be used with wheelchairs that originate from a wide variety of different manufacturers. This adjustability is also beneficial to the occupant of the wheelchair, as the adjustability can provide a wide variety of people having different shapes and sizes with a more custom fit. In order to provide this custom fit, the present invention provide for depth adjustability, height adjustability and angle adjustability of a wheelchair back.

The present invention also provides the convenience of a quick-release wheelchair back so that the wheelchair occupant can easily remove the back of the wheelchair from the canes so that the wheelchair can be collapsed and stored.

The present mounting system also provides for an effective two point mounting system that is reliable yet simple to use. The mounting system of the present invention provides a high degree of adjustability with respect to the angle that it can be inclined, particularly with respect to four-point mounting systems. Additionally, use of a two-point mounting system is particularly important with wheelchairs having short canes, such as those used by more active individuals, as it leaves room for other wheelchair accessories.

BRIEF DESCRIPTION OF THE DRAWINGS

FIG. 5 is a side elevational view of the angle adjustment bracket.

FIG. 6 is a top elevational view of the angle adjustment bracket.

FIG. 7 is a side and bottom perspective view of the angle adjustment bracket.

FIG. 19 is a side, front and top perspective view of the dual back clamp.

FIG. 20 is a front elevational view of the dual back clamp.

FIG. 21 is a top plan view of the dual back clamp.

FIG. 22 is a right side elevational view of the dual back clamp.

DETAILED DESCRIPTION

Figure 1:
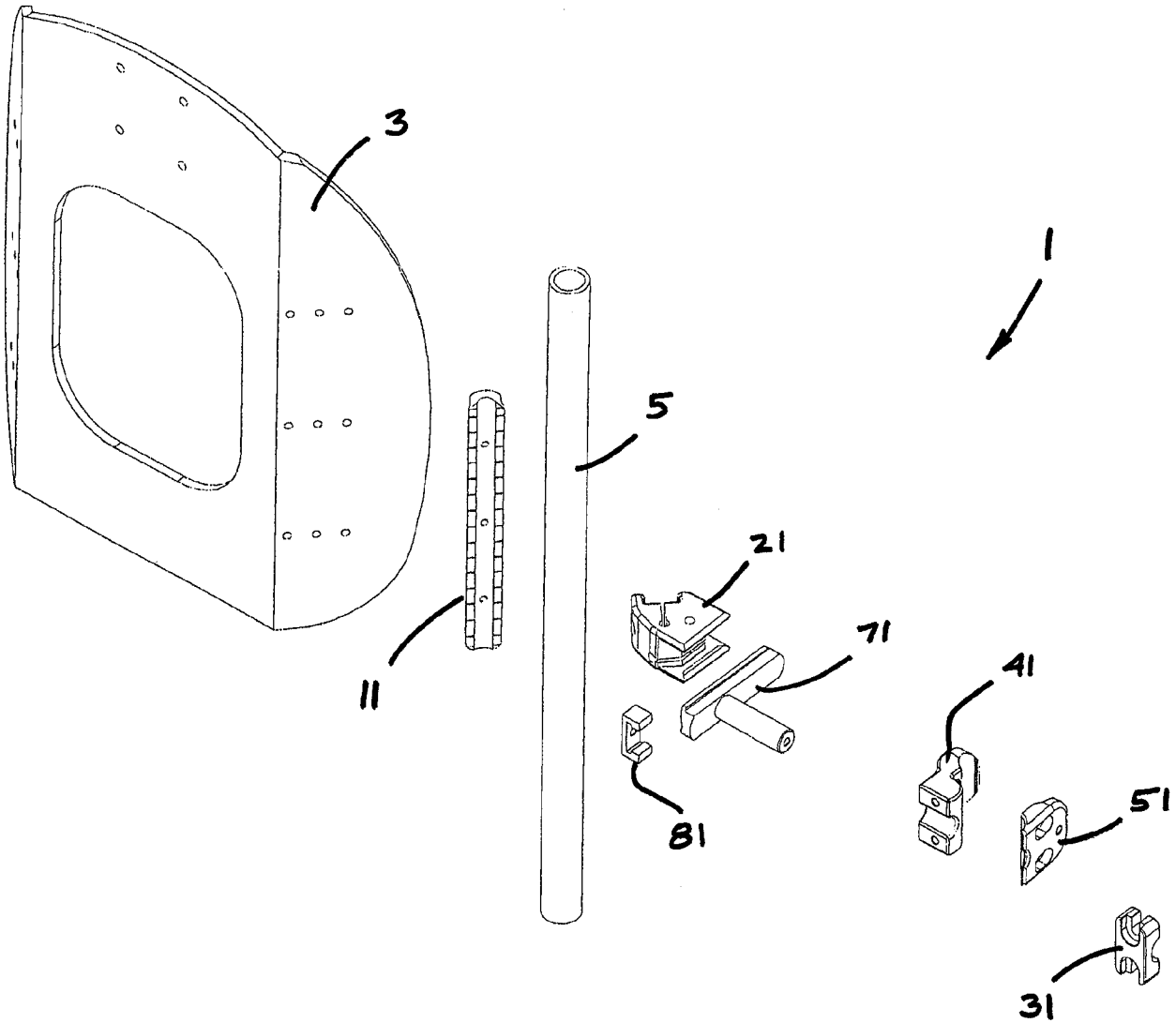
FIG. 1 shows an exploded view of the mounting apparatus disclosed in the present application.
Figure 2:
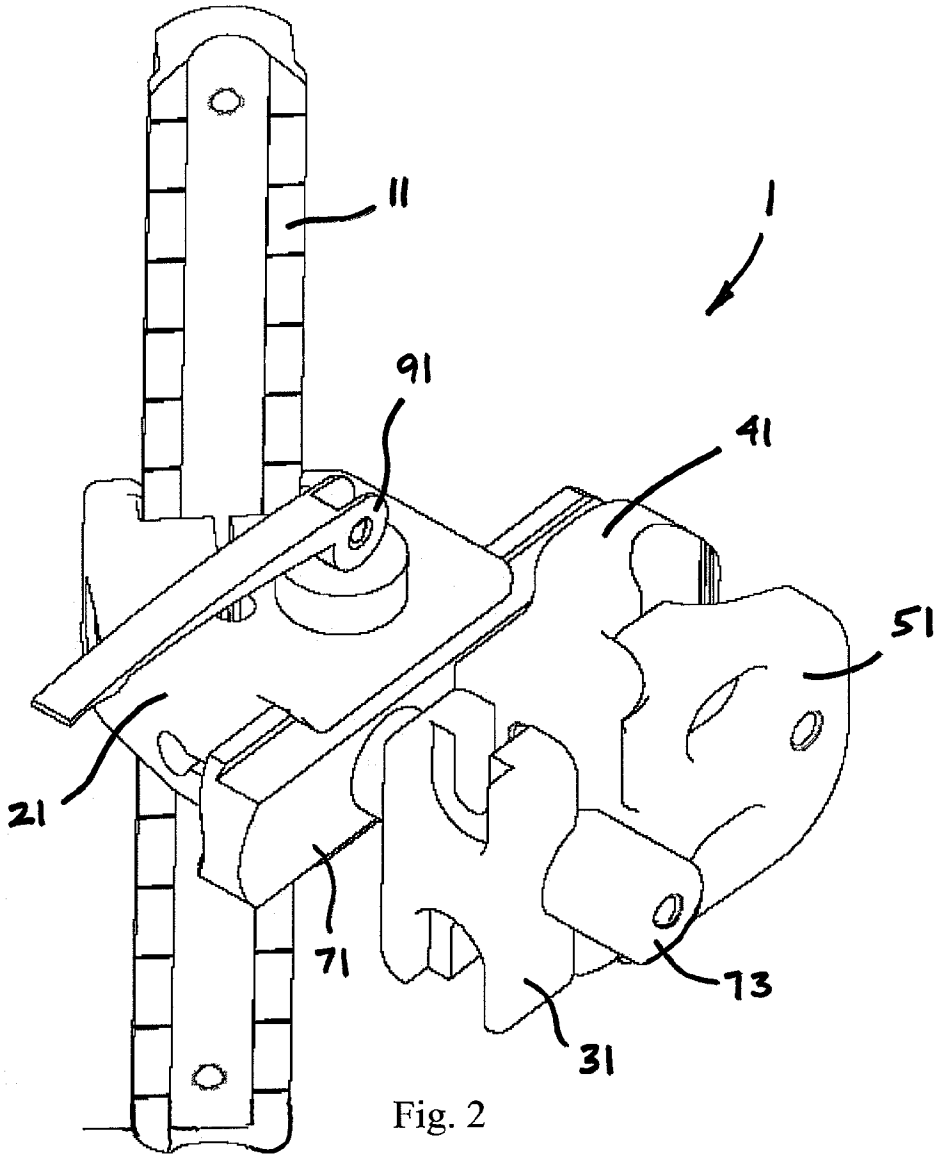
FIG. 2 shows a close in view of the mounting apparatus disclosed in the present application.

Now referring to the drawings in detail, wherein like numbered elements correspond to like elements throughout, FIG. 1 shows an exploded view of the Compass™ mounting system or apparatus, generally identified 1, used to secure a wheelchair back 3 to a wheelchair cane 5. In slightly more detail, FIG. 1 shows the T-stock height adjustment 11, the back dual clamper 21, the cane clamp angle adjustment bracket 31, the inner cane clamp 41, the outer cane clamp 51, the angle adjustment stud 71, and the safety stop 81. FIG. 2 provides a closer view of the mounting system 1 as it would be when assembled and mounted to a wheelchair back 3.

Although no particular wheelchair cane 5 is shown in FIG. 1, the Compass™ mounting system 1 can be used to secure a wheelchair back to wheelchairs with cane diameters ranging from 0.75"–1.125". Additionally, the compass mount system 1 requires only two (2) inches of cane length to be securely mounted to the wheelchair cane 5. This is especially advantageous in the case of wheelchairs having telescopic wheelchair canes 5, as the strongest point of the telescoping wheelchair cane 5 is at the base of the cane 5.

Figures 8, 9, 10:
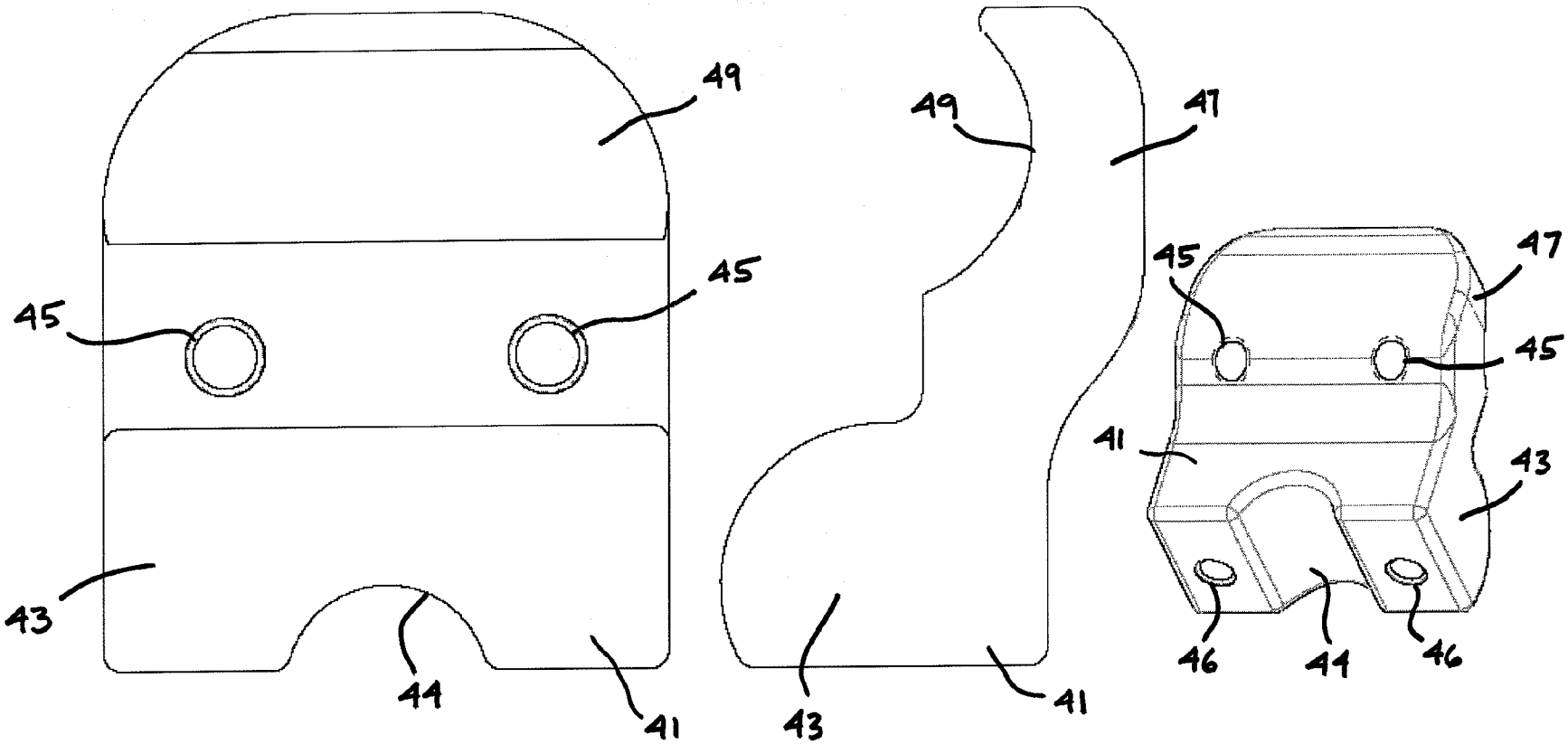
FIG. 8 is a top elevational view of the inner cane clamp.
FIG. 9 is a side elevational view of the inner cane clamp.
FIG. 10 is a back and side perspective view of the inner cane clamp.

Now referring to FIGS. 8, 9 and 10 which show the inner cane clamp 41 in detail, it will be seen that the inner cane clamp 41 can generally be described as having a base 43 having a first set and a second set of tapped apertures 45, 46, respectively, therethrough. The base 43 curves inwardly to form a narrower curved neck section 47 extending from the base 43. The neck section 47 has an inner radius 49 for contacting a wheelchair cane 5. The radius 49 is actually a double-hump radius in that it has an outer section accommodating a cane radius of up 1" and an inner radius accommodating a cane radius of 0.875". An additional feature of the inner cane clamp 41 is the rounded inset 44 which will be discussed in more detail later in this detailed description.

Figure 13:
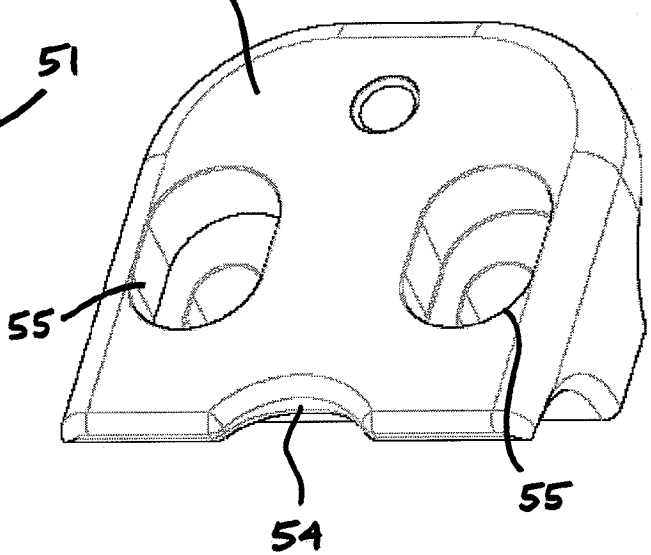
FIG. 13 is a top and side perspective view of the outer cane clamp.
Figure 12:
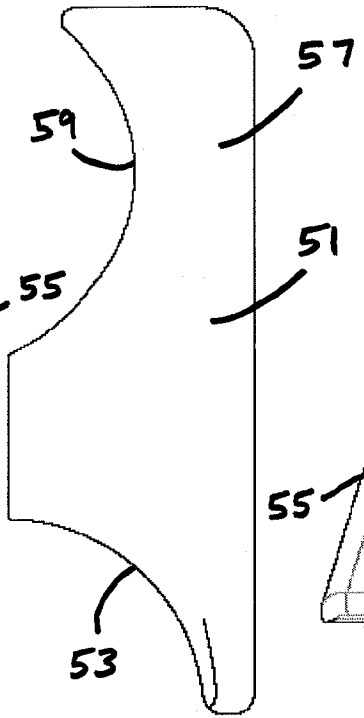
FIG. 12 is a side elevational view of the outer cane clamp.
Figure 11:
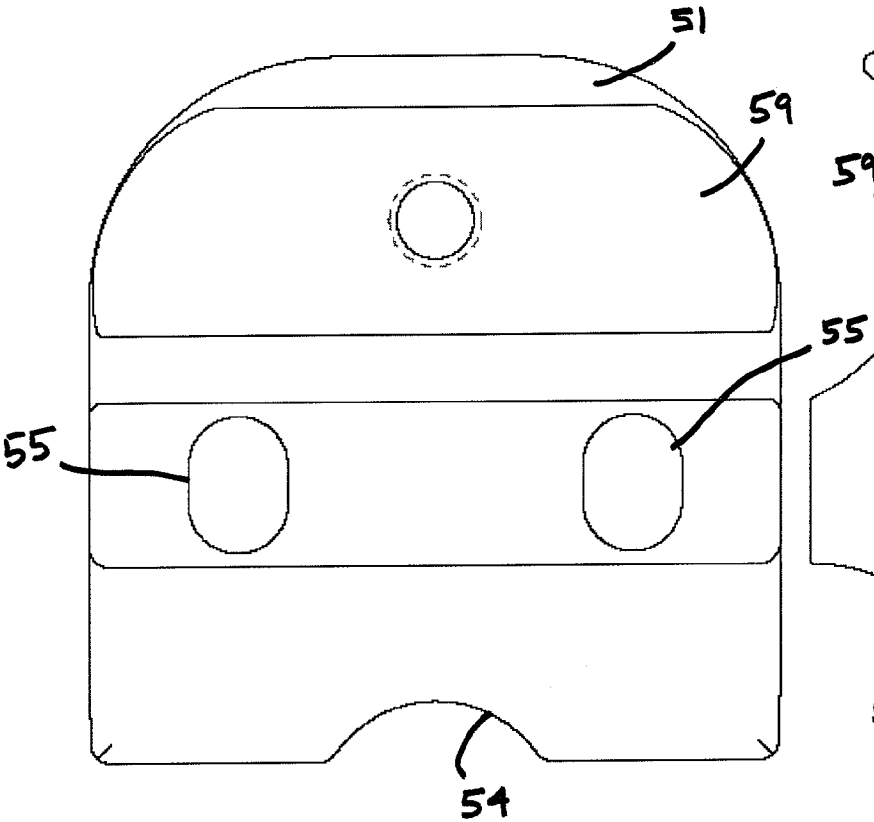
FIG. 11 is a top elevational view of the outer cane clamp.

Complementary to the inner cane clamp 41 is the outer cane clamp 51 as shown in FIGS. 11, 12 and 13. The outer cane clamp 51 can generally be described as having a curved base portion 53 which fits around the curved base 43 of the inner cane clamp 41. The outer cane clamp 51 also has a narrower neck portion 57 having a curved inner radius 59 for contacting a wheelchair cane 5. The radius 59 is actually a double-hump radius in that it has an outer section accommodating a cane radius of up 1" and an inner radius accommodating a cane radius of 0.875". An additional feature of the outer cane clamp 51 is the rounded inset 54 which will be discussed later in this detailed description.

It is to be understood that a pair of cane clamp screws, as shown in FIG. 1, are to be inserted through the first set of apertures 45 in the inner cane clamp 41 and through the set of apertures 55 in the outer cane clamp 51. The cane clamp screws can be tightened to provide compression to a wheelchair cane 5. The Compass™ mounting system 1 is thus held in place on the wheelchair cane 5 by pressure exerted by tightening of the screws.

Now referring to FIGS. 5, 6 and 7, which show the cane clamp angle adjustment bracket 31 in detail, the angle adjustment bracket 31 is attached to the inner cane clamp 41 via a pair of adjustment screws, as shown in FIG. 1, that are inserted through the passages 33 and are tightened into the second set of tapped apertures 46 of the inner cane clamp 41. The angle adjustment bracket 31 has an arched inset 34 that is disposed generally opposite to the arched insets 44, 54 of the inner cane clamp 41 and the outer cane clamp 51, respectively.

Figure 4:
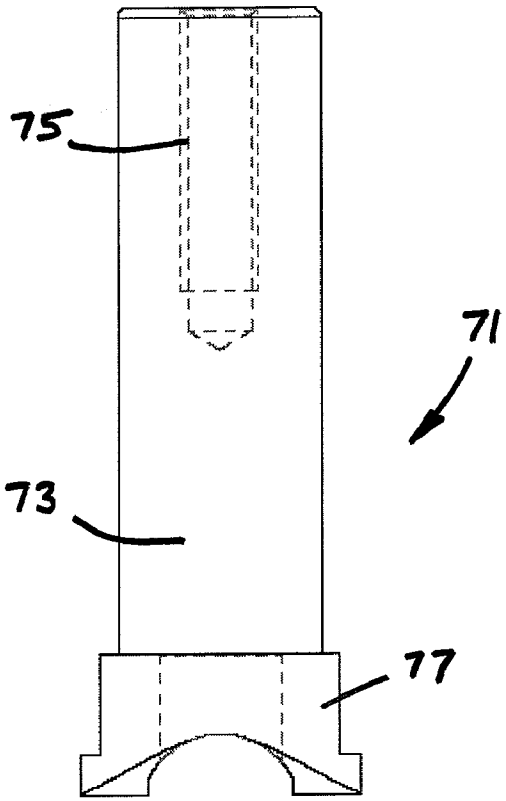
FIG. 4 shows a front view of the angle adjustment means of the mounting apparatus and the track system for use in depth adjustment of the wheelchair back.
Figure 3:
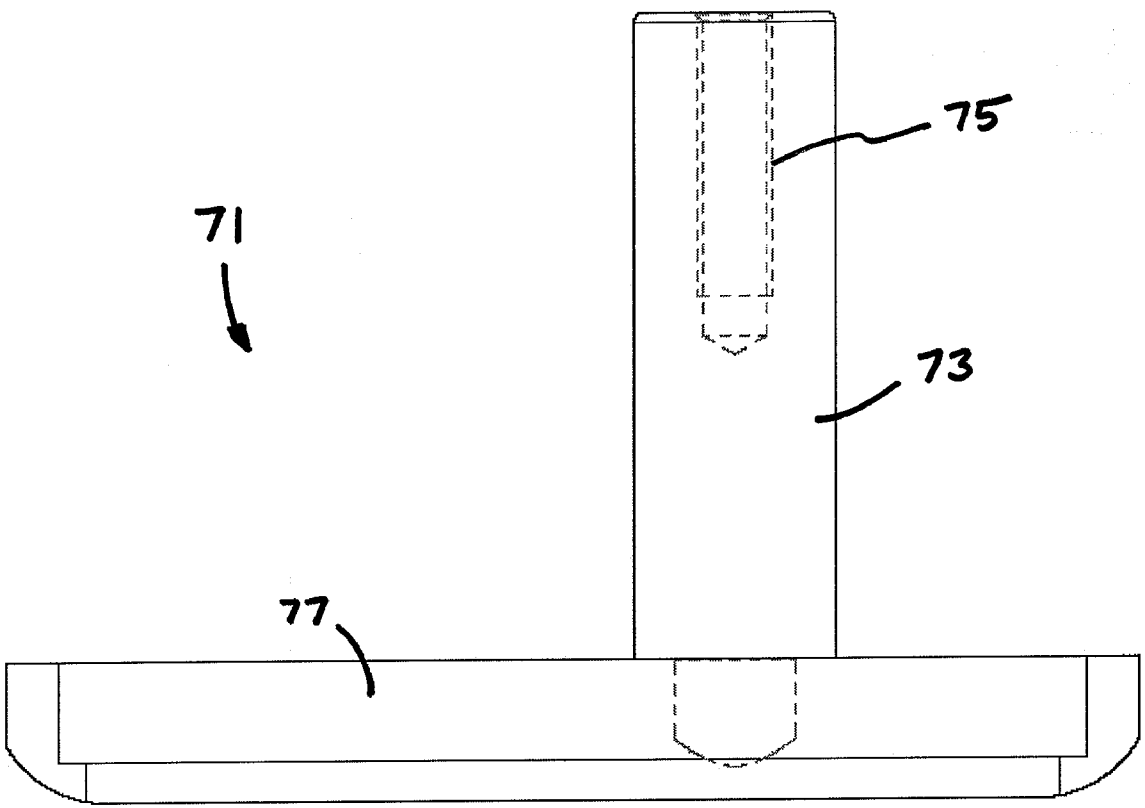
FIG. 3 shows a side view of the angle adjustment means of the mounting apparatus and the track system for use in depth adjustment of the wheelchair back.

Now referring to FIGS. 3 and 4, which show the angle adjustment stud 71, the device used for angle adjustment of the wheelchair back 3. The angle adjustment stud 71 can generally be considered to be comprised of two parts. First, there is a length of round stock 73. The length of round stock 73 is attached to a T-stock 77. The round stock 73 fits into the passage created by the inset archway 34 in the cane clamp angle adjustment bracket 31 and the complementary inset archways 44, 54 in the inner and outer cane clamps 41, 51, respectively. The angle adjustment screws are inserted through the passages 33 in the angle adjustment bracket 31 and are used to secure the round stock 73 in the passage created by the inset archways, 34, 44 in the cane clamp angle adjustment bracket 31 and the inner cane clamp 41, respectively.

The round stock 73 provides adjustment means for wheelchairs of differing widths. More specifically, the round stock 73 provides a means for extension in the form of a tapped aperture 75. The tapped aperture 75 permits the addition of a second length of round stock, thus permitting use of a wider wheelchair back 3.

As previously mentioned, the length of round stock 73 is attached to a piece of T-stock 77. The piece of T-stock 73 includes a track 77 and can be any particular embodiment of sliding rail or track, which is well known in the art. The T-stock track 77 is in physical connection with the first inset track acceptor 23 on the back dual clamper 21. See FIGS. 19 through 22. The back dual clamper 21 is so called because it contains a first inset track acceptor 23 and a second inset track acceptor 25. The first inset track acceptor 23 and the second inset track acceptor 25 are at right angles to one another. The first inset track acceptor 23 mates with the T-stock track 77 on the angle adjustment stud 71. The second inset track acceptor 25 mates with the T-stock track 11. Therefore, the back dual clamper 21 provides two directions of adjustment. Although a T-stock track 77 is used, other types of track are also acceptable for use with the invention. The requirements of the track 77 are that it simply include linear motion in one dimension.

Figure 18:
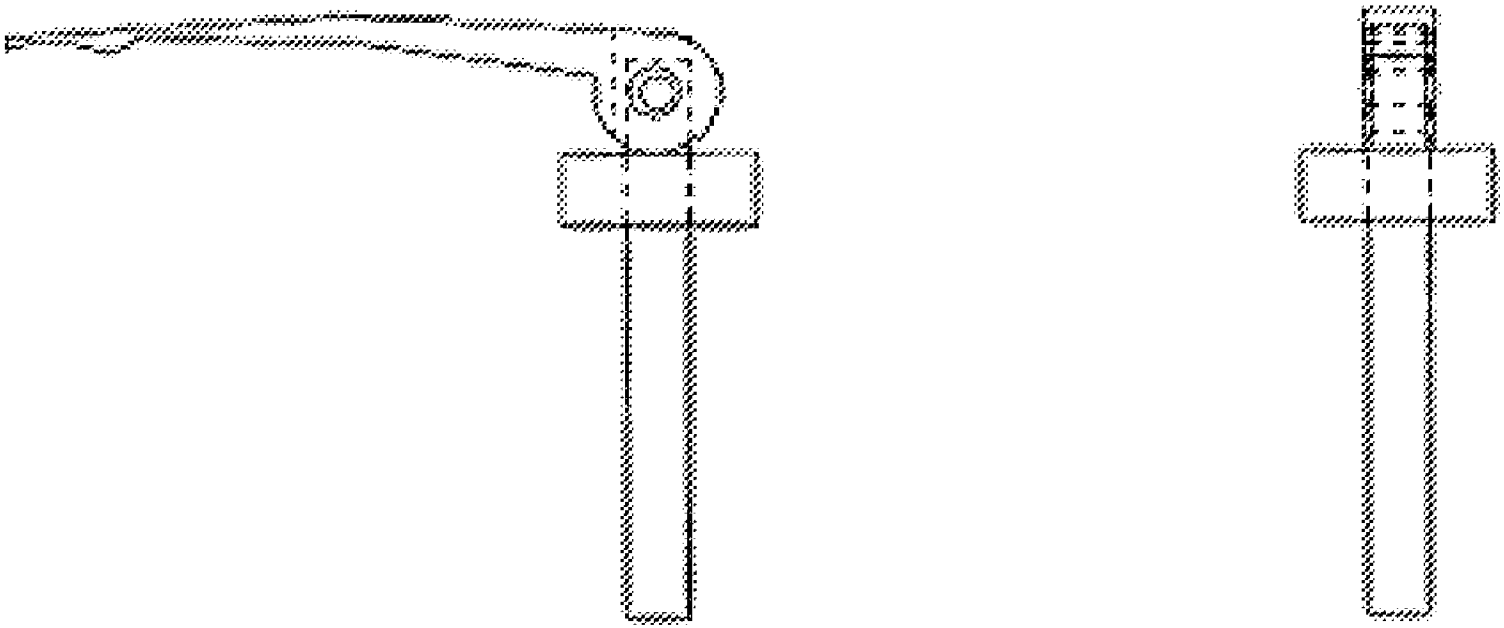
FIG. 18 is a side elevational view of the cam-lock quick release mechanism.

In application, the depth of the wheelchair back 3 in relation to the wheelchair seat is quickly and easily adjustable via a quick-release cam-lock 91 which is inserted through the aperture 29 in the back dual clamper 21 and tightened against a nut (not shown) on the other side of the back dual clamper 21. The back dual clamper has a relief, or slotted aperture 22 that permits the quick release 91 to clamp the back dual clamper on the T-stock track 77. See FIG. 18. The quick-release cam lock 91 permits a wheelchair occupant or health care provider to quickly release the clamp on the T-stock track 77 in order to adjust the depth of the wheelchair back 3. Additionally, if the wheelchair needs to be collapsed, the release of the cam lock 91 on each side of the wheelchair permits removal of the wheelchair back 3.

The dual back clamper 21 is attached to the T-stock height adjustment track 11 on the wheelchair back 3 and slides along the T-stock height adjustment track 11 to allow wheelchair adjustment. To secure the dual back clamper 21 to the T-stock height adjustment track 11 on the wheelchair back 3, the dual back clamper 21 provides a pair of passages 27 through which bolts (not shown) are inserted. When the wheelchair back 3 is positioned properly, the bolts are tightened, thus clamping the second inset track 25 to the T-stock height adjustment track 11. The back dual clamper 21 has a relief or an slotted aperture 22, which permits the user to clamp the dual back clamper 21 in place on the T-stock height adjustment track 11. In this way, the wheelchair back height is locked into place. The present invention also provides for a safety stop, such as is shown in FIGS. 14, 15 and 16.

Figure 15:
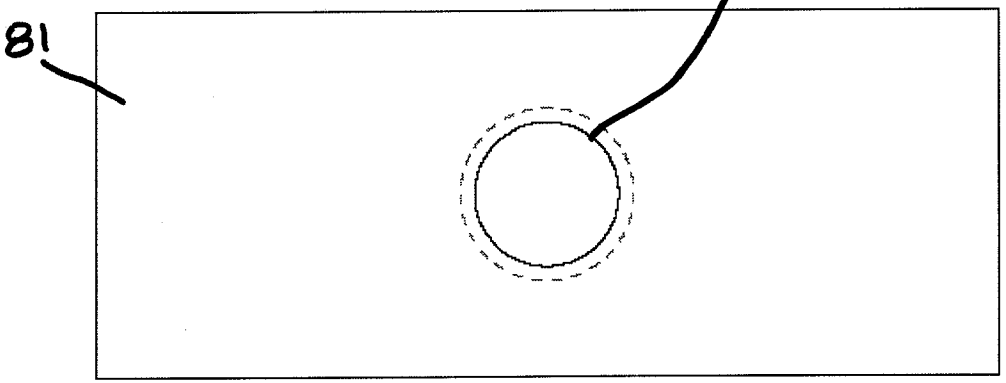
FIG. 15 is a top elevational view of the safety stop.
Figure 16:
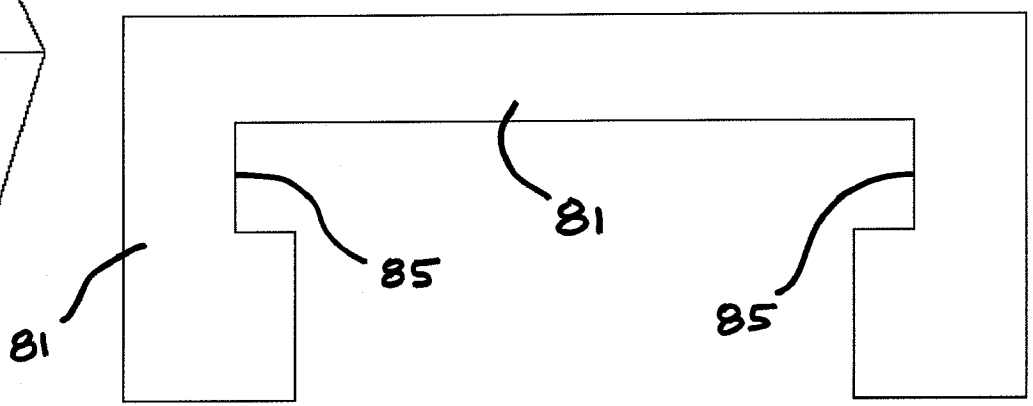
FIG. 16 is a side elevational view of the safety stop.
Figure 14:
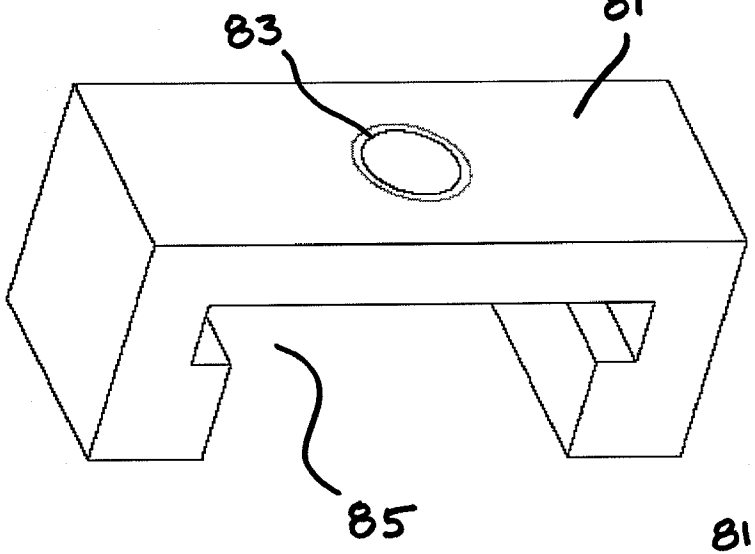
FIG. 14 is a side, front and top perspective view of the safety stop.
Figure 17:
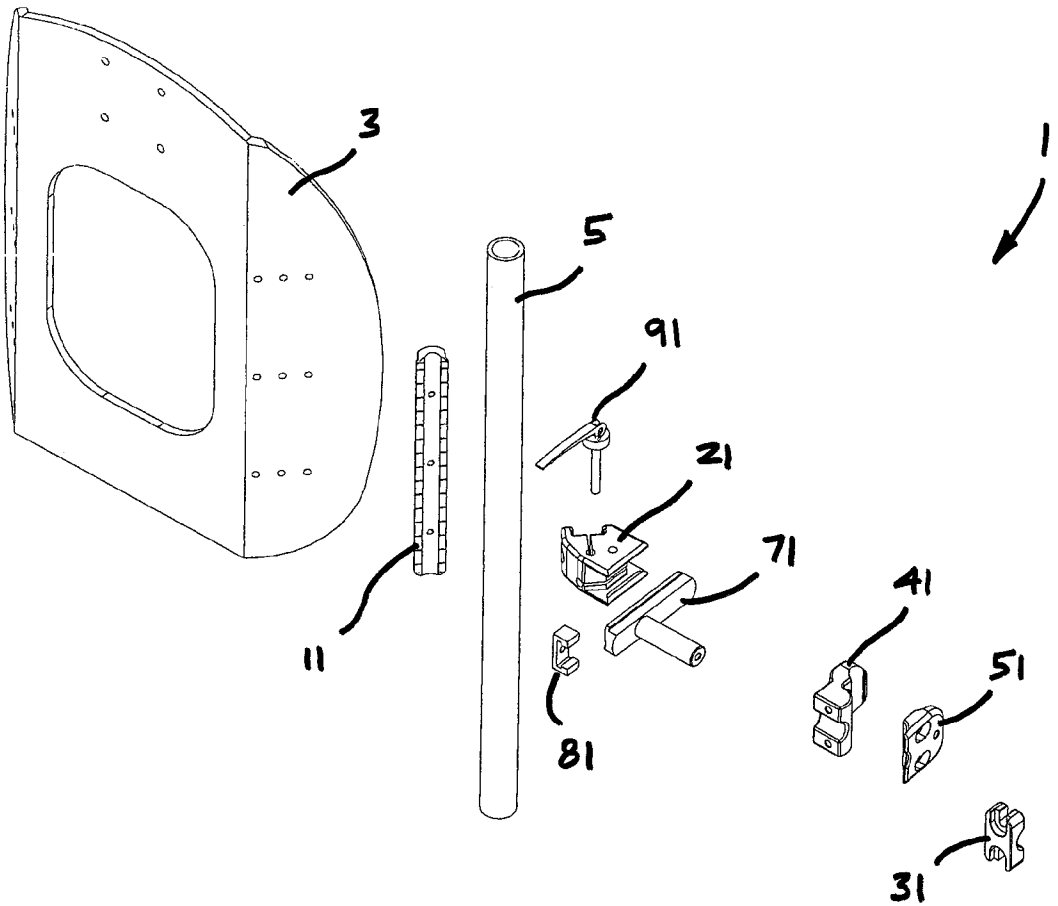
FIG. 17 shows an exploded view of an embodiment of the present invention that employs a cam-lock quick release mechanism.

FIGS. 14, 15 and 16 show the safety stop 81, which has a T-shaped inset 85 and is inserted over either of the T-stock height adjustment track 11 or the T-stock tracks 77 to prevent movement from a preset position. When the safety stop 81 is properly located, a screw (not shown) is threaded through the aperture 83 and tightened, thus eliminating the potential for motion in that direction. Frequently, the safety stops 81 are located on the T-stock track 77 so that that a wheelchair can properly locate the appropriate depth on the T-stock track 77 so as to not repeatedly need to refit the depth of the wheelchair back. Additionally, the wheelchair occupant is not permitted to push on the wheelchair back so hard as to overcome the quick-release mechanism 91. The safety stops 81 can also be located on the T-stock height adjustment track 11 on the wheelchair back 3.

The Compass™ mounting system 1 provides a single mount bracket system used to secure a wheelchair back to a wheelchair cane. This single mount system has many benefits, most important being that it requires only about 2" of space on each wheelchair cane. This permits ample space along the cane for the use of other wheelchair accessories such as pneumatic cylinders, respiratory aids, positioning equipment and bags. Additionally, in the case of wheelchairs having telescopic canes, use of the Compass™ mounting system permits attachment of the mounts lower on the canes, which is the strongest portion of the telescoping canes.

The single mount system also provides a large amount of adjustment travel in five degrees of motion. By simply loosening the two bolts (not pictured) in the threaded apertures 27, a wheelchair back can be adjusted vertically a total of 6.8". The Compass™ mounting system 1 provides for quick and easy storage of the present invention in that the wheelchair back can be removed by the operation of two quick-release cam locks.

Lastly, the present mounting system provides for angle adjustment of ±20° by simply loosening two bolts on each side of the wheelchair back 3. What is especially important about the Compass™ hardware is that the patient does not need to be transferred during any of these adjustments. Other systems require the back to be unloaded. Each time a patient is transferred they run the risk of injury in the fitting stage for patients about to use a wheelchair as it alleviates the burden of transferring the patient into and out of the wheelchair.

Although I have very specifically described the preferred embodiments of the invention herein, it is to be understood that changes can be made to the improvements disclosed without departing from the scope of the invention. Therefore, it is to be understood that the scope of the invention is not to be overly limited by the specification and the drawings, but is to be determined by the broadest possible interpretation of the claims.

What is claimed is:

1. An apparatus for mounting a wheelchair back to the cane of a wheelchair comprising:

an inner cane clamp having a first set of tapped apertures and a second set of tapped apertures;

an outer cane clamp having a set of apertures;

a pair of cane clamp bolts inserted through the first set of tapped apertures in the inner cane clamp and the apertures in the outer cane clamp to tighten the inner and outer cane clamps around the cane of the wheelchair;

a vertical track attached to the wheelchair back;

an angle adjustment stud having an angle adjustment track;

a dual back clamper having a first track inset permitting sliding attachment to the wheelchair back and a second track inset permitting sliding attachment to the angle adjustment track;

a cane clamp bracket being attached to the inner cane clamp, the cane clamp bracket providing an aperture, the aperture of the cane clamp bracket accommodating the angle adjustment stud; and the cane clamp bracket also including a set of apertures through which bolts are inserted into the inner cane clamp to tighten the cane clamp bracket against the inner cane clamp, thus immobilizing the angle adjustment stud.

2. The apparatus for mounting a wheelchair back of claim 1 further comprising an aperture in the dual back clamper;

a quick-release cam lock inserted through the aperture of the dual back clamper and being used to releasably secure the angle adjustment track to the dual back clamper thus preventing the relative motion of the angle adjustment track in relation to the dual back clamper.

3. The apparatus for mounting a wheelchair back of claim 1 further comprising a plurality of safety stops, the safety stops being designed to prevent the motion of a wheelchair back in the event the quick release mechanism fails.

4. An apparatus for mounting a rigid wheelchair back to a wheelchair, the wheelchair having a seat and a pair of upright vertical posts, or canes on either side of the seat, the apparatus comprising:

an inner cane clamp having a first set of tapped apertures and a second set of tapped apertures;

an outer cane clamp having a set of apertures;

a pair of cane clamp bolts inserted through the first set of tapped apertures in the inner cane clamp and the apertures in the outer cane clamp to tighten the inner and outer cane clamps;

an angle adjustment stud having a length of track;

a cane clamp bracket being attached to the inner cane clamp, the cane clamp bracket providing an aperture, the aperture of the cane clamp bracket accommodating the angle adjustment stud;

the cane clamp bracket also including a set of apertures through which bolts are inserted into the inner cane clamp to tighten the cane clamp bracket against the inner cane clamp, thus immobilizing the angle adjustment stud;

a vertically oriented track; and a dual back clamper having a first track inset being slidably attached to the vertical track, the dual back clamper also having a bolt for securing the dual back clamper to a particular level on the vertical track and a second track inset permitting slidable attachment to the length of track on the angle adjustment track.

5. The apparatus for mounting a wheelchair back of claim 4 further comprising an aperture in the dual back clamper;

a quick-release cam lock inserted through the aperture of the dual back clamper and being used to releasably secure the angle adjustment track to the dual back clamper thus preventing the relative motion of the angle adjustment track in relation to the dual back clamper.

6. The apparatus for mounting a wheelchair back of claim 4 further comprising a plurality of safety stops, the safety stops being designed to prevent the motion of a wheelchair back in the event the quick release mechanism fails.

7. An apparatus for mounting a rigid wheelchair back to a wheelchair, the wheelchair having a seat and a pair of upright vertical posts, or canes on either side of the seat, the apparatus comprising:

an inner cane clamp having a first set of tapped apertures and a second set of tapped apertures;

an outer cane clamp having a set of apertures;

a pair of cane clamp bolts inserted through the first set of tapped apertures in the inner cane clamp and the apertures in the outer cane clamp to tighten the inner and outer cane clamps;

an angle adjustment stud generally comprising a rounded stud, the rounded stud being inserted through a passage in the inner and outer cane clamps and further being attached to a length of track;

a cane clamp bracket being attached to the inner cane clamp, the cane clamp bracket providing an aperture, the aperture of the cane clamp bracket accommodating the angle adjustment stud;

the cane clamp bracket also including a set of apertures through which bolts are inserted into the inner cane clamp to tighten the cane clamp bracket against the inner cane clamp, thus immobilizing the angle adjustment stud;

a dual back clamper having a first track inset and a second track inset permitting the sliding attachment to the length of track on the angle adjustment stud permitting horizontal, or nearly horizontal, motion of the wheelchair back; and a track attachable to a wheelchair back for accommodating the first track inset of the dual back clamper and permitting motion in a vertical orientation.

8. The apparatus for mounting a wheelchair back of claim 7 further comprising an aperture in the dual back clamper;

a quick-release cam lock inserted through the aperture of the dual back clamper and being used to releasably secure the angle adjustment track to the dual back clamper thus preventing the relative motion of the angle adjustment track in relation to the dual back clamper.

9. The apparatus for mounting a wheelchair back of claim 7 further comprising a plurality of safety stops, the safety stops being designed to prevent the motion of the wheelchair back in the event the quick release mechanism fails.

* * * * *